US009416616B2

(12) United States Patent
Delzell et al.

(10) Patent No.: US 9,416,616 B2
(45) Date of Patent: Aug. 16, 2016

(54) ASSISTING RETRIEVAL OF A DOWNHOLE TOOL

(71) Applicant: Halliburton Energy Services, Inc., Houston, TX (US)

(72) Inventors: Christopher Robert Delzell, Plano, TX (US); William Mark Richards, Frisco, TX (US); William David Henderson, Tioga, TX (US); Bryon Mullen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/420,309

(22) PCT Filed: Nov. 16, 2012

(86) PCT No.: PCT/US2012/065439
§ 371 (c)(1),
(2) Date: Feb. 6, 2015

(87) PCT Pub. No.: WO2014/077830
PCT Pub. Date: May 22, 2014

(65) Prior Publication Data

US 2015/0198005 A1 Jul. 16, 2015

(51) Int. Cl.
*E21B 23/06* (2006.01)
*E21B 33/128* (2006.01)
*E21B 33/129* (2006.01)

(52) U.S. Cl.
CPC ..... *E21B 33/128* (2013.01); *E21B 23/06* (2013.01); *E21B 33/129* (2013.01)

(58) Field of Classification Search
CPC . E21B 33/1295; E21B 23/06; E21B 33/1285; E21B 33/128; E21B 33/129
See application file for complete search history.

(56) References Cited

U.S. PATENT DOCUMENTS 4,457,369 A 7/1984 Henderson
4,754,814 A * 7/1988 Jordan, Jr. ..... E21B 33/1295 166/120
5,311,938 A 5/1994 Hendrickson et al.
5,720,343 A 2/1998 Kilgore et al.
5,810,082 A * 9/1998 Jordan, Jr. ..... E21B 33/1295 166/120
5,884,699 A 3/1999 Mullen et al.
5,893,413 A * 4/1999 Lembcke ..... E21B 23/04 166/321
6,997,252 B2 2/2006 Porter et al.

(Continued)

OTHER PUBLICATIONS

PCT International Preliminary Report on Patentability, PCT/US2012/065439, May 28, 2015, 12 pages.

(Continued)

*Primary Examiner* — Daniel P Stephenson
(74) *Attorney, Agent, or Firm* — Scott Richardson; Fish & Richardson P.C.

(57) ABSTRACT

A well tool includes: a well packer; a hydraulic sub-assembly coupled to the well packer; an anti-preset assembly coupled to the hydraulic sub-assembly; a slip assembly coupled to the anti-preset assembly; and a fold-back assembly coupled between the well packer and the hydraulic sub-assembly. The well packer includes an expandable member that rides on a mandrel extending at least a portion of the well tool. The fold-back assembly includes a bias member carried on the mandrel and adapted to engage a profile formed on the mandrel based on a setting stroke that adjusts the expandable member into an expanded position in substantially sealing contact with a tubular.

22 Claims, 10 Drawing Sheets

(56) References Cited

U.S. PATENT DOCUMENTS

| | | | | |
|---|---|---|---|---|
| 7,392,851 | B2 | 7/2008 | Brennan, III et al. | |
| 7,552,769 | B2 | 6/2009 | Cherewyk | |
| 8,550,177 | B2 * | 10/2013 | Henckel | E21B 33/129 166/125 |
| 2010/0012330 | A1 * | 1/2010 | Ezell | E21B 33/1295 166/387 |
| 2011/0056676 | A1 * | 3/2011 | Birner | E21B 33/1295 166/120 |
| 2011/0147000 | A1 * | 6/2011 | Bolding | E21B 33/1285 166/332.8 |
| 2015/0198005 | A1 * | 7/2015 | Delzell | E21B 33/128 166/180 |

OTHER PUBLICATIONS

Authorized Officer Jong Kyung Lee, PCT International Search Report and Written Opinion, PCT/US2012/065439, Jul. 25, 2013, 16 pages.

* cited by examiner

ASSISTING RETRIEVAL OF A DOWNHOLE TOOL

CROSS-REFERENCE TO RELATED APPLICATIONS

This application is a 371 U.S. National Phase Application and claims the benefit of priority to PCT Application Serial No. PCT/US2012/065439, filed on Nov. 16, 2012 and entitled "Assisting Retrieval of a Downhole Tool", the contents of which are hereby incorporated by reference.

BACKGROUND

This disclosure relates to a well tool for use in subterranean well systems.

Downhole tools such as packers, valves, and other devices used in subterranean well systems, are often inserted into a wellbore and later retrieved from the wellbore once a downhole operation is completed. In some cases, retrieval of the reservoir pressure isolation tools or other well tools is made more difficult due to the inexact nature of well construction. For instance, edges of components of the reservoir pressure isolation tool or other well tool may become stuck on a tubular casing within the wellbore, requiring extremely large forces to be applied to free the tools to the surface.

DETAILED DESCRIPTION

Figure 1:
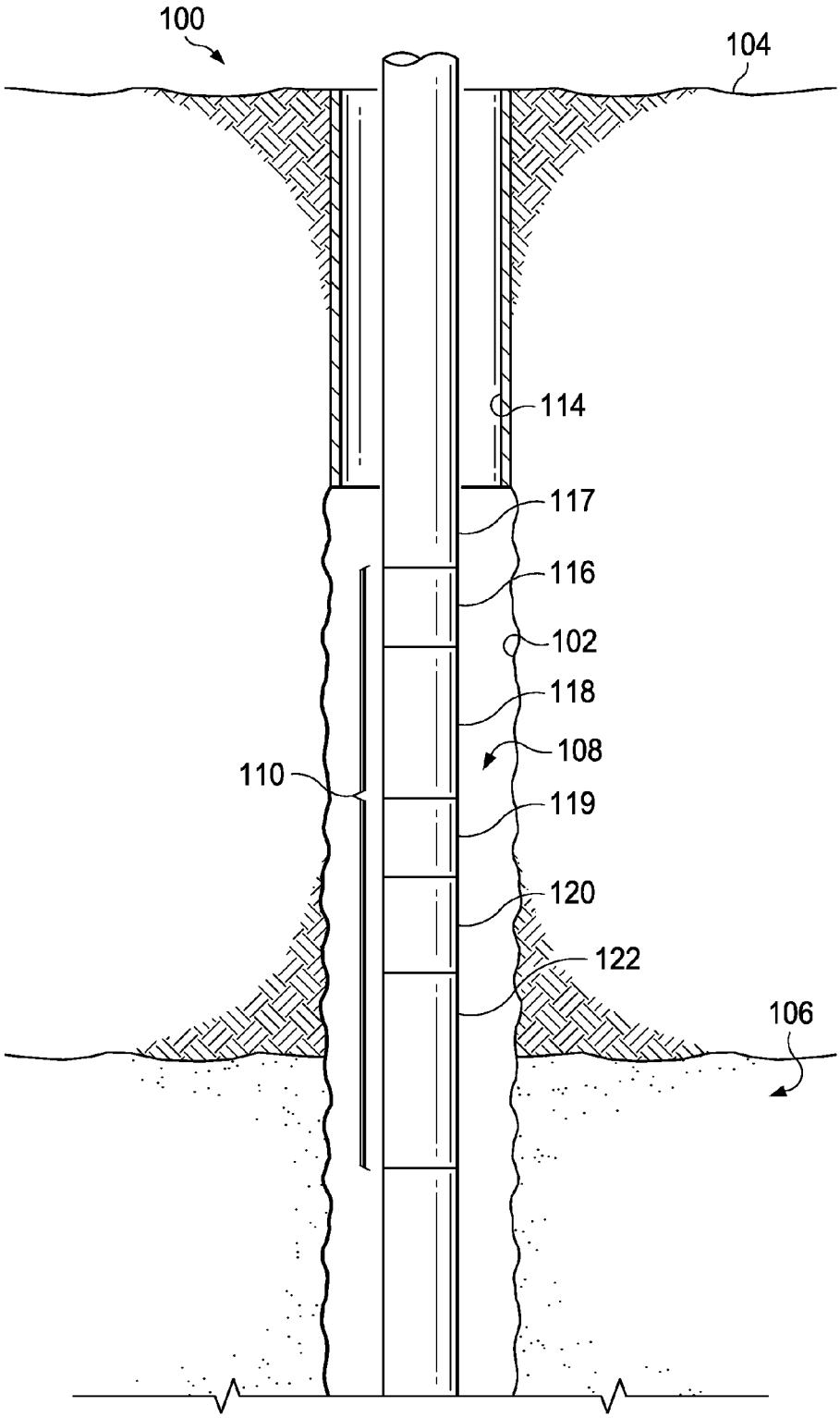
FIG. 1 illustrates a side view of an example well system that includes a well tool string that includes a fold-back assembly.

In one general implementation, a well packer includes an expandable member carried on a mandrel, the mandrel including a groove formed on at least a portion of an outer radial surface of the mandrel; a back-up assembly carried on the mandrel adjacent the expandable member; and a fold back assembly carried on the mandrel adjacent the back-up assembly, the fold back assembly including a snap ring carried on the mandrel and adapted to move into the groove and adjust the expandable member into an expanded position in substantially sealing contact with a tubular.

In a first aspect combinable with this general implementation, the snap ring is radially-biased inwardly toward the mandrel.

A second aspect combinable with any of the previous aspects further includes a shear ring carried on the mandrel adjacent the snap ring and fixed to an adapter with a shear member the adapter riding on the mandrel and over at least a portion of the snap ring in a run-in position of the well packer.

In a third aspect combinable with any of the previous aspects, the shear member is adapted to shear in response to a force to initiate a setting stroke to urge the well packer from the run-in position to an expanded position, and an uphole surface of the snap ring defines a no-go shoulder in the expanded position.

In a fourth aspect combinable with any of the previous aspects, the snap ring is adapted to move into the groove based on the setting stroke.

A fifth aspect combinable with any of the previous aspects further includes a hydraulic sub-assembly adapted to urge an upper sleeve of the well packer towards the expandable member and a lower sleeve of the well packer towards a slip assembly that includes a gripping edge.

A sixth aspect combinable with any of the previous aspects further includes an anti-preset assembly adapted to prevent adjustment of the expandable member into the expanded position prior to initiation of the setting stroke.

In a seventh aspect combinable with any of the previous aspects, the snap ring moves independently of operation of the hydraulic sub-assembly and the anti-preset assembly when the well packer is adjusted from the run-in position to the expanded position.

An eighth aspect combinable with any of the previous aspects further includes a sleeve that rides on the mandrel and abuts the back-up assembly the sleeve held abutting the back-up assembly by the snap ring when the well packer is in a retrieval position.

In a ninth aspect combinable with any of the previous aspects, the expanded position includes one of a plurality of expanded positions based on a dimension of the tubular, the expandable member in substantially sealing contact with the tubular when in the plurality of expanded positions.

In another general implementation, a method includes moving a well packer into the well bore in a run-in position, the well packer including an expandable member carried on a mandrel, the mandrel including a groove formed on at least a portion of an outer radial surface of the mandrel, the back-up shoe adjacent the expandable member in the run-in position; receiving a setting force to adjust the well packer from the run-in position to an expanded position, the expandable member in substantial contact with a tubular of the well bore in the expanded position; urging the snap ring into the groove with a stroke of the packer; adjusting the expandable member from the expanded position to a retrieval position; and deforming the back-up shoe with forcible contact on the shoe by a sleeve abutting a shoulder of the snap ring.

In a first aspect combinable with this general implementation, the snap ring is radially-biased inwardly toward the mandrel.

A second aspect combinable with any of the previous aspects further includes shearing a shear member that fixes an adapter to a shear ring carried on the mandrel adjacent the snap ring, the adapter riding on the mandrel and over at least a portion of the snap ring in the run-in position of the well packer.

A third aspect combinable with any of the previous aspects further includes contactingly moving the snap ring into the groove by the shear ring.

In a fourth aspect combinable with any of the previous aspects, the uphole surface of the snap ring defines a no-go shoulder in the expanded position.

A fifth aspect combinable with any of the previous aspects further includes preventing adjustment of the expandable member into the expanded position with an anti-preset assembly while the well packer is in the run-in position.

A sixth aspect combinable with any of the previous aspects further includes urging an upper sleeve of a hydraulic sub-assembly coupled with the well packer towards the expandable member based on the setting force.

A seventh aspect combinable with any of the previous aspects further includes urging a lower sleeve of the hydraulic sub-assembly towards a slip assembly that includes a gripping edge.

In an eighth aspect combinable with any of the previous aspects, urging the snap ring into the groove by the setting force includes urging the snap ring into the groove by the setting force independently of operation of the hydraulic sub-assembly and the anti-preset assembly when the well packer is adjusted from the run-in position to the expanded position.

In a ninth aspect combinable with any of the previous aspects, the expanded position includes one of a plurality of expanded positions based on a dimension of the tubular, the expandable member in substantially sealing contact with the tubular when in the plurality of expanded positions.

In another general implementation, a well tool includes a well packer that includes an expandable member that rides on a mandrel extending at least a portion of the well tool; a hydraulic sub-assembly coupled to the well packer; an anti-preset assembly coupled to the hydraulic sub-assembly; a slip assembly coupled to the anti-preset assembly; and a fold-back assembly coupled between the well packer and the hydraulic sub-assembly, the fold-back assembly including a bias member carried on the mandrel and adapted to engage a profile formed on the mandrel based on a setting stroke that adjusts the expandable member into an expanded position in substantially sealing contact with a tubular.

In a first aspect combinable with this general implementation, the bias member is radially-biased inwardly toward the mandrel.

In a second aspect combinable with any of the previous aspects, the fold-back assembly further includes a ring member carried on the mandrel adjacent the bias member.

In a third aspect combinable with any of the previous aspects, the ring member includes one of a shear ring fixed to an adapter carried on the mandrel with a shear member; a spring positioned between a shoulder of the adapter and the bias member; or a moldable member positioned between a shoulder of the adapter and the bias member.

In a fourth aspect combinable with any of the previous aspects, the shear member is adapted to shear in response to a force to initiate the setting stroke to adjust the expandable member into the expanded position, and an uphole surface of the bias member defines a no-go shoulder in the extended position.

In a fifth aspect combinable with any of the previous aspects, the profile includes a groove, and the spring maintains a substantially constant force on the bias member to urge the bias member into the groove.

In a sixth aspect combinable with any of the previous aspects, the moldable member includes a thermoplastic member including a glass transition temperature at or below a particular temperature in the well bore.

In a seventh aspect combinable with any of the previous aspects, the thermoplastic member is adapted to transfer a force from the adapter to the snap ring when the particular temperature is below the glass transition temperature.

In an eighth aspect combinable with any of the previous aspects, the thermoplastic member is adapted to flow through a bore in the adapter in fluid communication with the well bore when the particular temperature is above the glass transition temperature.

In a ninth aspect combinable with any of the previous aspects, the bias member includes a body lock ring, and the profile includes a threaded surface adapted to engage the body lock ring.

In a tenth aspect combinable with any of the previous aspects, the hydraulic sub-assembly is adapted to urge an upper sleeve towards the expandable member and a lower sleeve towards the slip assembly that includes a gripping edge to maintain the well tool at a particular position in a well bore.

In an eleventh aspect combinable with any of the previous aspects, the anti-preset assembly is adapted to prevent adjustment of the expandable member into the expanded position prior to initiation of the setting stroke.

In a twelfth aspect combinable with any of the previous aspects, the bias member moves independently of operation of the hydraulic sub-assembly and the anti-preset assembly when the expandable member is adjusted to the expanded position.

Various implementations of a well tool according to the present disclosure may include one, some, or all of the following features. For example, the well tool may include a fold-back assembly that may be used with a reservoir pressure isolation tool, such as, for example, a hydraulic or hydrostatic set packer. The fold-back assembly may help aid in retrieval of the reservoir pressure isolation tool and/or other downhole tools coupled to the reservoir pressure isolation tool from a wellbore disposed in a subterranean zone. For instance, the fold-back assembly may minimize, help prevent, or prevent one or more components of the reservoir pressure isolation tool and/or other downhole tools coupled to the reservoir pressure isolation tool from catching on a tubular in the wellbore (e.g., a casing, casing collar, or other tubular). The well tool may also be actuated independently of other downhole tools within a tool string. For instance, the well tool may be coupled within a tool string that includes a hydraulic or hydrostatic set packer, an anti-preset tool (e.g., to prevent premature actuation of the packer), sealing system, and a set of slips. The well tool may be actuated independently of, for example, the anti-preset device.

Various implementations of a well tool according to the present disclosure may also include one, some, or all of the following features. For example, the well tool may be implemented with a variable expansion sealing system that can expand to anchor and seal to two or more positions depending on a tubular diameter of a casing adjacent the packer in a wellbore. For instance, the well tool may be actuated to a first position corresponding to a minimum expansion setting of the sealing system and further actuated to a second position corresponding to a maximum expansion setting of the sealing system. As a further example, the well tool may remain disengaged in a run-in position, thereby preventing an unintended activation of another well tool. Further, the well tool may be compatible with existing hydraulic or hydrostatic set packers. The well tool may also be compatible with existing anti-preset devices that are used with hydraulic or hydrostatic set packers. In addition, the well tool may maintain existing packer pickup locations of a hydraulic or hydrostatic set packer and does not see a load from a hang weight. The well tool may disengage the sealing system from the well bore. The well tool may disengage the back-up system of the sealing system from the well bore.

FIG. 1 illustrates a side view of an example well system 100 that includes a well tool string that includes a fold-back assembly constructed in accordance with the concepts herein.

The well system 100 is provided for convenience of reference only, and it should be appreciated that the concepts herein are applicable to a number of different configurations of well systems. As shown, the well system 100 includes a substantially cylindrical well bore 102 that forms a borehole 108 that extends from well head (not shown) at a terranean surface 104 through one or more subterranean zones of interest 106. In FIG. 1, the well bore 102 extends substantially vertically from the surface 104 into the subterranean zone 106. However, in other instances, the well bore 102 can be of another configuration, for example, entirely substantially vertical or slanted, it can deviate horizontally or in another manner than horizontal, it can be a multi-lateral, and/or it can be of another configuration.

The well bore 102 is lined with a casing 114, constructed of one or more lengths of tubing, that extends from the surface 104, downhole, toward the bottom of the well 102. The casing 114 provides radial support to the well bore 102 and seals against unwanted communication of fluids between the well bore 102 and surrounding formations. Here, the casing 114 ceases at a particular location above the subterranean zone 106 and the remainder of the well bore 102 is an open hole, i.e., uncased. In other instances, the casing 114 can extend to the bottom of the well bore 102 or can be provided in another configuration. In some implementations, the casing 114 is constructed of joints of tubulars that are coupled together with collars at the joints.

A completion string 117 of tubing and other components is coupled to the well head and extends, through the well bore 102, downhole, into the subterranean zone 106. The completion string 117, generally, is tubing that is used, once the well is brought onto production, to produce fluids from, and inject fluids into, the subterranean zone 106. Prior to bringing the well onto production, the completion string may be used to perform the final steps in constructing the well.

The completion string 117 is shown coupled to several downhole well tools that make up a well tool string 110. The well tool string 110 includes, starting at an uphole end of the string 110, a sealing system 116, a well tool 118 with a fold-back assembly, a hydraulics section 119, an anti-preset device 120, and a set of slips 122. The well tool string 110, as illustrated, may be coupled to a tubular or other tool string downhole of the slips 122. Although illustrated as a string of separate tools, the components of the string 110 (e.g., sealing system 116, well tool 118, hydraulic section 119, anti-preset device 120, and slips 122) may be constructed together, may be constructed as a single downhole tool (e.g., carried on a single or continuous mandrel), may be separately coupled (e.g., threadingly), or may be constructed according to other techniques.

The completion string 117, in an example embodiment, may be a hydraulically actuated or hydrostatic set packer. The completion string 117 includes the sealing system 116. Sealing system 116 may be actuated (e.g., expanded radially outward from the tool string 110) to contact the well bore 102 and seal an annulus between the tool string 110 and the well bore 102 against fluid communication past the packer. Thus, the packer may enable controlled production (e.g., of hydrocarbon fluids from the subterranean zone 106 to the surface 104), injection (e.g., fluid from the surface 104 to the zone 106) or treatment of the zone 106. As a hydraulic or hydrostatic set packer, an expandable member of the packer may be actuated (e.g., expanded to contact the well bore 102) based on a fluid provided downhole to the packer or a pressure due to a buildup of fluids in the borehole 108.

In some implementations, the sealing system 116 is operable to anchor to the well bore 102 (or other tubular) and seal an annulus between the system 116 and the well bore 102. For example, the sealing system 116 may include a sealing element (e.g., elastomer, thermoplastic, or metal) and a mechanical back-up system to prevent extrusion of the sealing element. In some aspects, the back-up system may prevent (all or partially) extrusion, loss of material, or loss of material strain (e.g., sealing stresses needed to seal). In some implementations, the back-up system may be a metal back-up that contacts the well bore 102 or a casing installed in the well bore 102. The back-up system may be a solid ring or petal type back-up, or multiple petals nested together, or a combination thereof. The sealing element of the sealing system 116, in some aspects, retracts from sealing against the well bore 102 or other tubular when the sealing system 116 is released. The back-up system, however, once deformed into the new shape, may remain deformed due to stress. During retrieval the sealing system 116, the deformed back-up system may hang on one or more contact points within the well bore 102. Thus, disabling or reshaping of the back-up system may help prevent or minimize such hang-ups.

The well tool 118, as explained in more detail below, includes a fold-back assembly that, in some cases, may assist in retrieval of the tool string 110 and specifically the device 116 from the well bore 104. For example, in some implementations, a fold-back assembly of the well tool 118 may be actuated (e.g., extended) against a back-up shoe to bend or deform the shoe to help prevent the shoe from catching on a restriction in the well bore 102, such as a casing restriction. In some implementations, the well tool 118 may be actuated independently of other tools in the string 110, such as, for example, the hydraulic section 119, anti-preset tool 120, the slips 122, a sealing system 116), or other component of tool string 110.

The hydraulic section 119 is coupled within the string 110 downhole of the well tool 118 in the illustrated implementation. Generally, the hydraulic section 119 facilitates actuation of the sealing system 116 and slips 112 in the case of a hydraulic or hydrostatic set packer. Typically, "actuation" of the packer includes expansion of the sealing system and slips 122 radially outward toward the well bore 102 by applying compression to the sealing elements and back-up system (in the case of production packers) or pumping a fluid into a bladder (in the case of inflatable packers) to expand the sealing element under the metal back-up slats or compressing a seal system to expand the seal and deploy the back-ups system (in the case of an open hole packer). Generally, in the illustrated implementation, the hydraulic section 119 may receive a signal (e.g., electrical or mechanical including hydraulic) and expand an upper sleeve toward the sealing system 116 and a lower sleeve toward the slips 122.

The anti-preset tool 120 is coupled downhole of the hydraulic section 119 in the illustrated tool string 110. Generally, the anti-preset tool 120 functions to prevent or help prevent the sealing system 116 and slips 122 (e.g., packer) from being actuated while the tool string 110 is running into the well bore 102 or otherwise not in a preferable position in the well bore 102. For example, as described above, the sealing system 116 may be actuated by expanding upper and lower sleeves apart in the hydraulic section 119. One or more collets in the anti-preset tool 120 may be disposed on one of the upper or lower sleeves and may grip the other of the sleeves to substantially prevent opposing movement of the sleeves (e.g., to actuate the sealing system 116). In response to the signal, a telescoping part of the lower sleeve is moved axially prior to moving the remainder of the lower sleeve to position a relief (e.g., groove, notch, or otherwise) under the collets. The relief provides room for the collets to move radially and release their grip as the upper and lower sleeves are axially extended.

The slips 122, generally, anchor the well tool string 110 at a particular position in the borehole 118, e.g., in order to prevent tool string movement during downhole operations such as zone stimulation or production flow from a zone. The slips 112 anchor the well tool string before actuating the sealing system 116. In some implementations, the slips 122 may include edged or serrated outer surfaces (e.g., teeth) that are radially expanded to contact the wellbore, as well as edged or serrated outer surfaces (e.g., teeth) that are radially expanded to contact the well bore. Gripping engagement of the outer surfaces of the slips 122 with the well bore 102 (or other tubular) may thus constrain the tool string 110 from uphole/downhole movement.

Figure 2A:
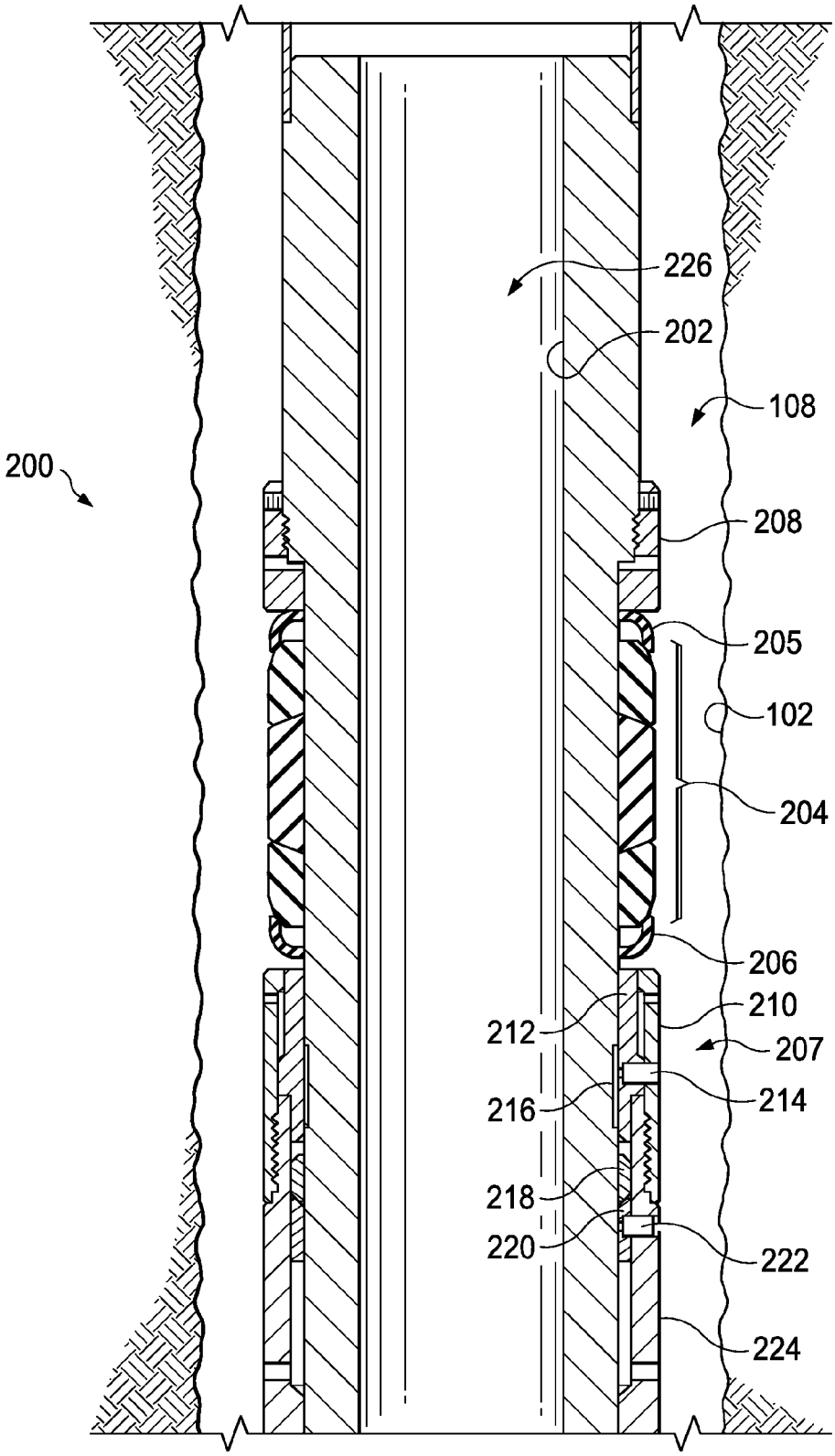
FIGS. 2A-2B illustrate more detailed sectional views of an example well tool string that includes a fold-back assembly in a run-in position.
Figure 2B:
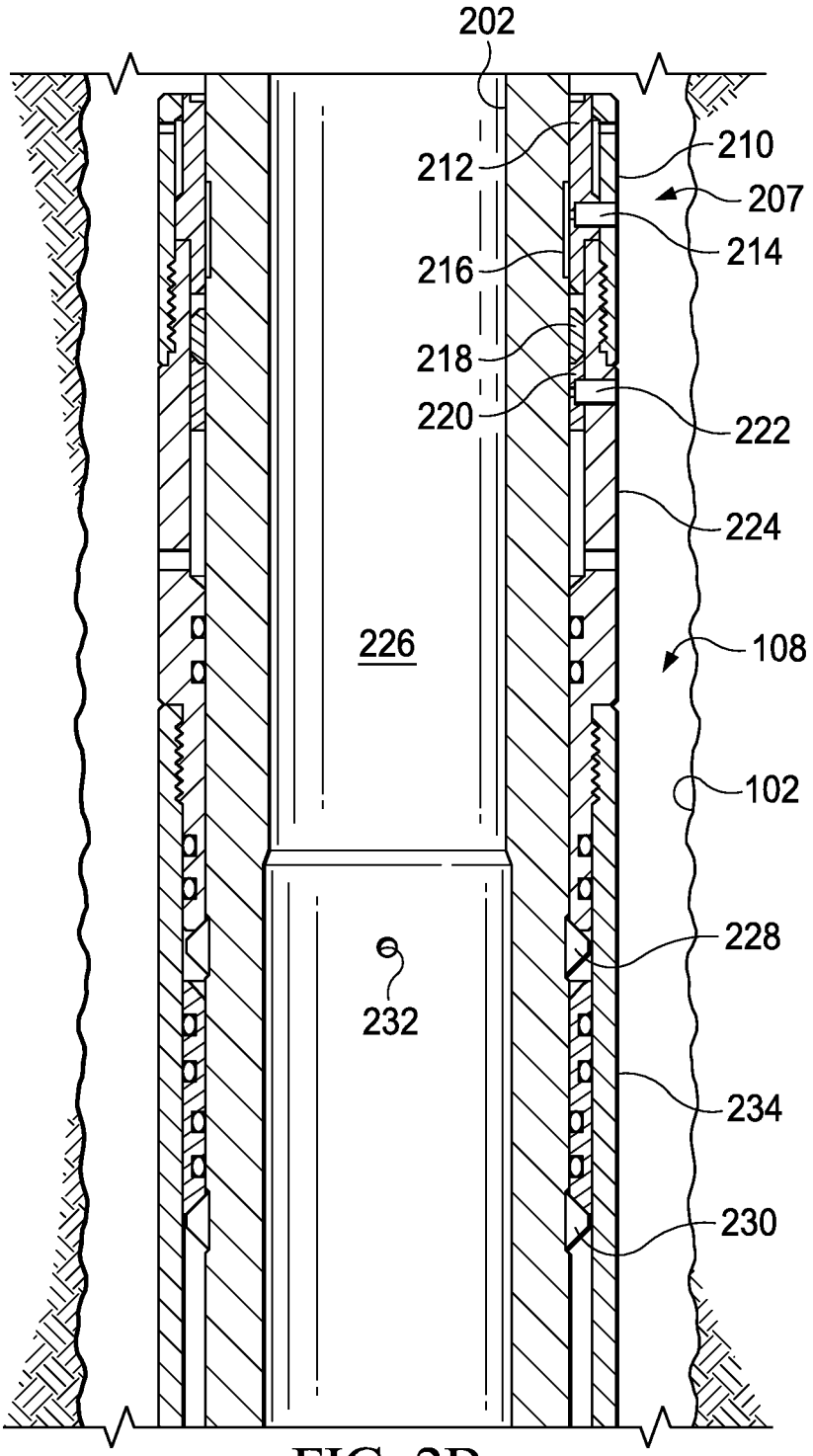

FIGS. 2A-2B illustrate more detailed sectional views of an example well tool string 200, in a run-in position, that includes a fold-back assembly. In some implementations, the well tool string 200 illustrated in FIGS. 2A-2B (as well as FIGS. 3A-3B, 4A-4B, and 5A-5B) may be used in the well system 100 in place of one or more components of the well tool string 110. For instance, as explained more fully below, the well tool string 200 may illustrate an example implementation of portions of the sealing system 116 and the well tool 118.

Turning to FIGS. 2A-2B, the well tool string 200 is shown in a run-in position. The well tool string 200 includes a mandrel 202 that extends from an uphole portion of the string 200 towards a downhole end of the string 200 and defines a bore 226 therethrough. An expandable member 204 rides on the mandrel 202 and is flanked on uphole and downhole sides by a back-up shoe 205 and a back-up shoe 206, respectively. An upper retainer 208 rides on the mandrel 202 uphole of the expandable member 204 and the back-up shoe 205 and provides a setting shoulder against which the expandable member 204 may be squeezed.

Riding on the mandrel 202 downhole of the back-up shoe 206 is a fold-back assembly 207 that includes a lower retainer 210 and a sleeve 212 that are carried on the mandrel 202 and fixed together in the run-in position by a shear member 214 (e.g., a pin, screw, ring, or otherwise). The lower retainer 210 is coupled to an adapter 224 that is fixed to a shear ring 220 with a shear member 222 (e.g., a pin, screw, ring, or otherwise). Riding on the mandrel 202 between the shear ring 220 and the sleeve 212 is a snap ring 218. As illustrated in FIG. 2A, for instance, the snap ring 218, in the run-in position, is positioned downhole from a groove 216 on the outer radial surface of the mandrel 202. The groove 216 is formed, in this example implementation, at a determined location from the expandable member 204 and with a determined width. In some implementations, as described below, the determined location and/or determined width of the groove 216 on the mandrel 202 based on one or more characteristics of the expandable member 204. For example, in some implementations, the groove 216 (as well as, in some cases, the snap ring 218) may be designed (e.g., width, location, size) based on a minimum expansion size of the expandable member 204, a maximum expansion size of the expandable member 204, or a combination thereof. The minimum and/or maximum expansion sizes of the expandable member 204 may be based, for instance, on a range of inner diameters of which the well bore 102 may have. Thus, the well tool string 200 may be implemented, without modification or without substantial modification, in a range of well bore sizes.

Downhole from the fold-back assembly 207 is a set of lugs 228 and 230 that are carried on the mandrel 202. Formed in the illustrated mandrel 202 is a port 232 through which, for instance, a fluid may provide a hydraulic setting force or other pressurized force to activate one or more portions of the well tool string 200.

As illustrated in FIGS. 2A-2B, in the run in position, the expandable member 204 is in a unactuated, or deflated, state. The shear member 214 holds the lower retainer 210 with the sleeve 212 while the shear member 222 holds the adapter 224 with the shear ring 220. The run-in position of the well tool string 200 may be utilized, for example, to move the well tool string 200 into the borehole 108 and to a particular depth in the well bore 102. Once at the particular depth, an anchor mechanism, such as the slips 122, may be actuated to hold the well tool string 200 at the particular depth so that the expandable member 204 may be actuated at a particular location in the well bore 102.

Figure 3A:
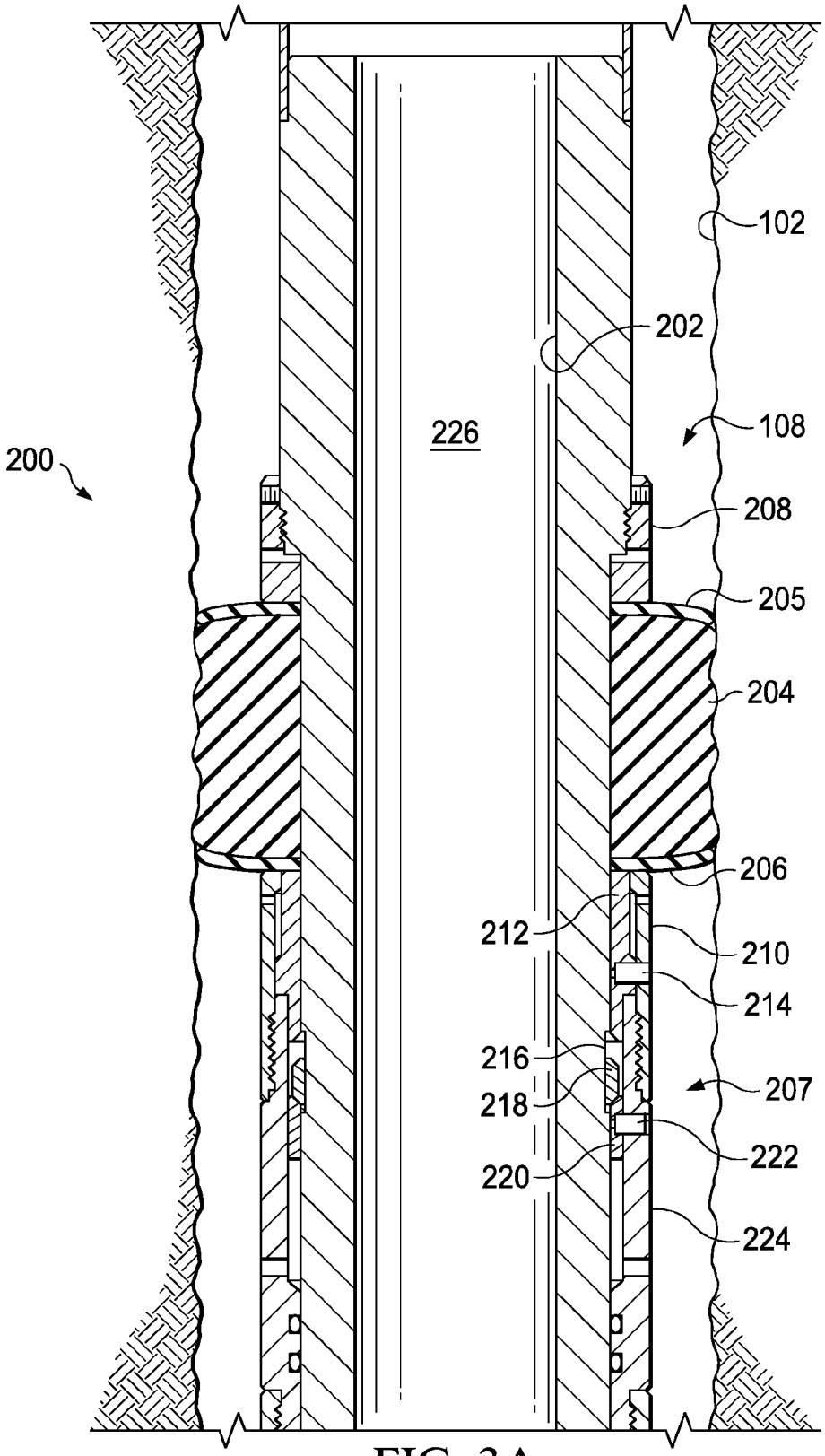
FIGS. 3A-3B illustrate more detailed sectional views of an example well tool string that includes a fold-back assembly in a first actuated position.
Figure 3B:
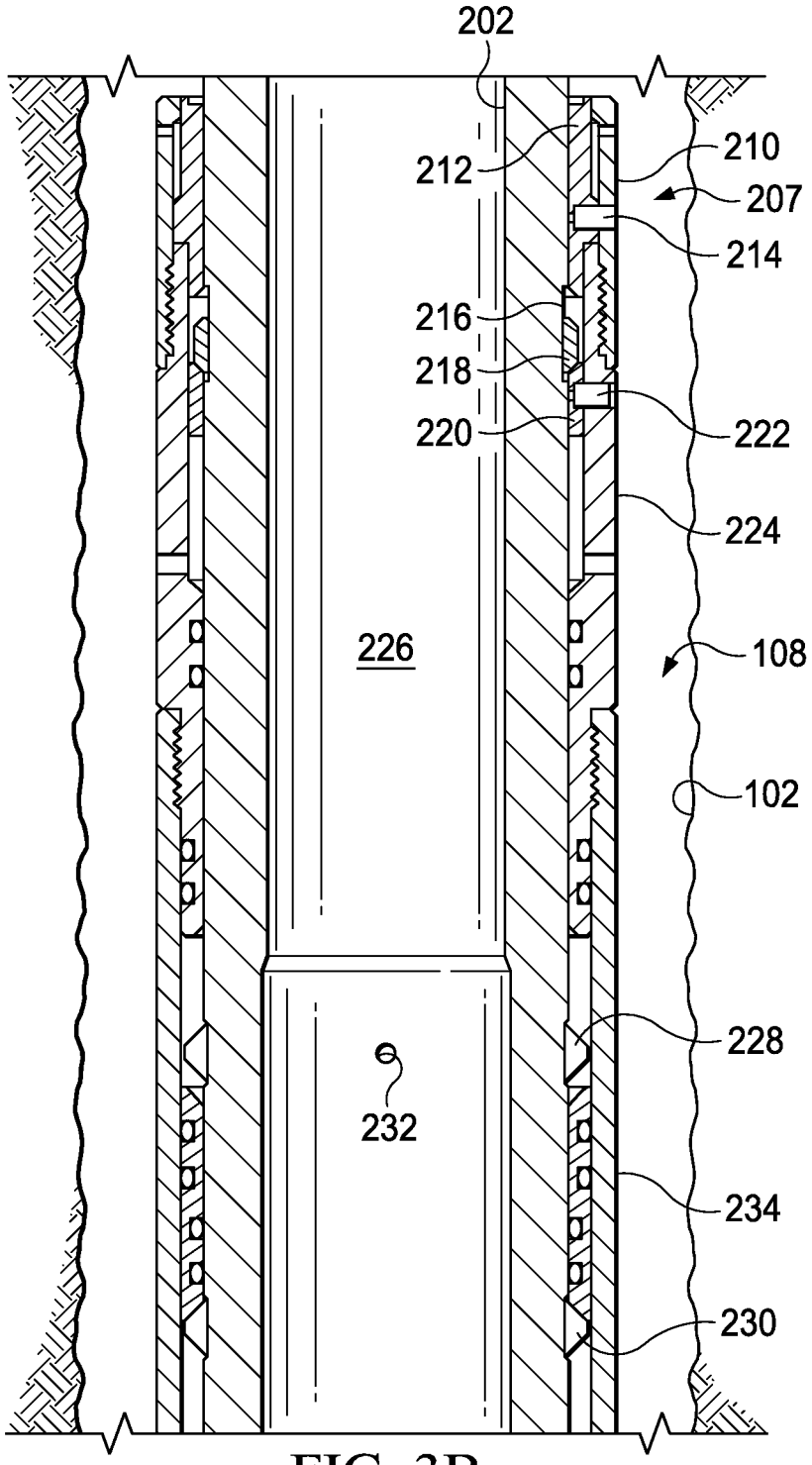

Turning to FIGS. 3A-3B, the well tool string 200 is illustrated in a first actuated position with the expandable member 204 activated (e.g., inflated, squeezed, or otherwise) to a first expanded position. In some implementations, the first expanded position may correlate to a particular inflation percentage of the expandable member 204 to contactingly engage the well bore 102 of a particular inner diameter (e.g., a minimum inner diameter of a range of inner diameters). In the first position, however, the well tool string 200 is fully operational in that no additional actuation may be necessary to begin operations (e.g., production operations) with the expandable member 204 engaged with the well bore 102.

In one example operation, the well tool string 200 is adjusted from the run-in position to the first actuated position by applying a force (e.g., mechanical, hydraulic, hydrostatic) to an piston housing 234 that is positioned on the mandrel 202 downhole of the fold-back assembly 207 and the lug 230. In some implementations, for example, hydraulic pressure is communicated through the port 232 in order to apply an uphole-directed force on the piston housing 234. In response, the piston housing 234 transmits the force (directly or indirectly) to the fold-back assembly 207 (e.g., through the adapter 224). The fold-back assembly 207 then moves as a unit, for instance, to contact the back-up shoe 206 with the lower retainer 210 and the sleeve 212 (e.g., simultaneously or substantially simultaneously). The force is transmitted to the expandable member 204, which abuts the upper retainer 208 and is compressed together to expand to its first expansion position.

As illustrated, in the first actuated position, the snap ring 218 is urged uphole by the shear ring 220 until it snaps into the groove 216 that is formed on the mandrel 202. For example, in some implementations, the snap ring 218 may be formed as a c-ring with a bias urging it against the mandrel 202. Thus, as the snap ring 218 is urged uphole, it fits snugly against the mandrel surface in the groove 216. Although this example implementation uses a c-ring biased snap ring, other implementations may utilize other biased members that function similar to the described snap ring 220.

Alternatively, in place of the snap ring 218, the fold-back assembly 207 may include a body lock ring to accomplish the functionality of the snap ring 218. For example, a body lock ring (e.g., a rigid or flexible c-ring or split ring) may include an inner radial surface that is ratcheted (e.g., with teeth) so as to allow uphole movement of the lock ring while constraining downhole movement of the lock ring on the mandrel 202. The body lock ring may, therefore, be urged uphole by the shear ring 220 while substantially preventing downhole movement, thereby providing for a shoulder to which the sleeve 212 may abut (as described below) with or without the groove 216.

The snap ring 218 may also, in an alternative implementation, be replaced by spring loaded lugs. For example, the lugs may be spring biased to snap into the groove 216 when urged uphole by the shear ring 220 and to provide a shoulder to which the sleeve 212 may abut (as described below).

As noted above, the distance that the groove 216 is, e.g., milled into an outer surface of the mandrel 202 from the expandable member 204 may correlate to a particular inner diameter of the well bore 102 (and in some cases with other characteristics). In addition, in some implementations, a particular distance that the snap ring 218 is from the groove 216 in the run-in position (which is traversed in adjusting to the first actuated position) may also correlate to a particular inner diameter of the well bore 102. Thus, the snap ring 218 may be positioned on the mandrel 202 at a position based on a known or expected inner diameter (e.g., minimum, maximum, range or otherwise) of the well bore 102. Also, a width of the groove 216 may be formed based on a known or expected inner diameter (e.g., minimum, maximum, range or otherwise) of the well bore 102.

Figure 4A:
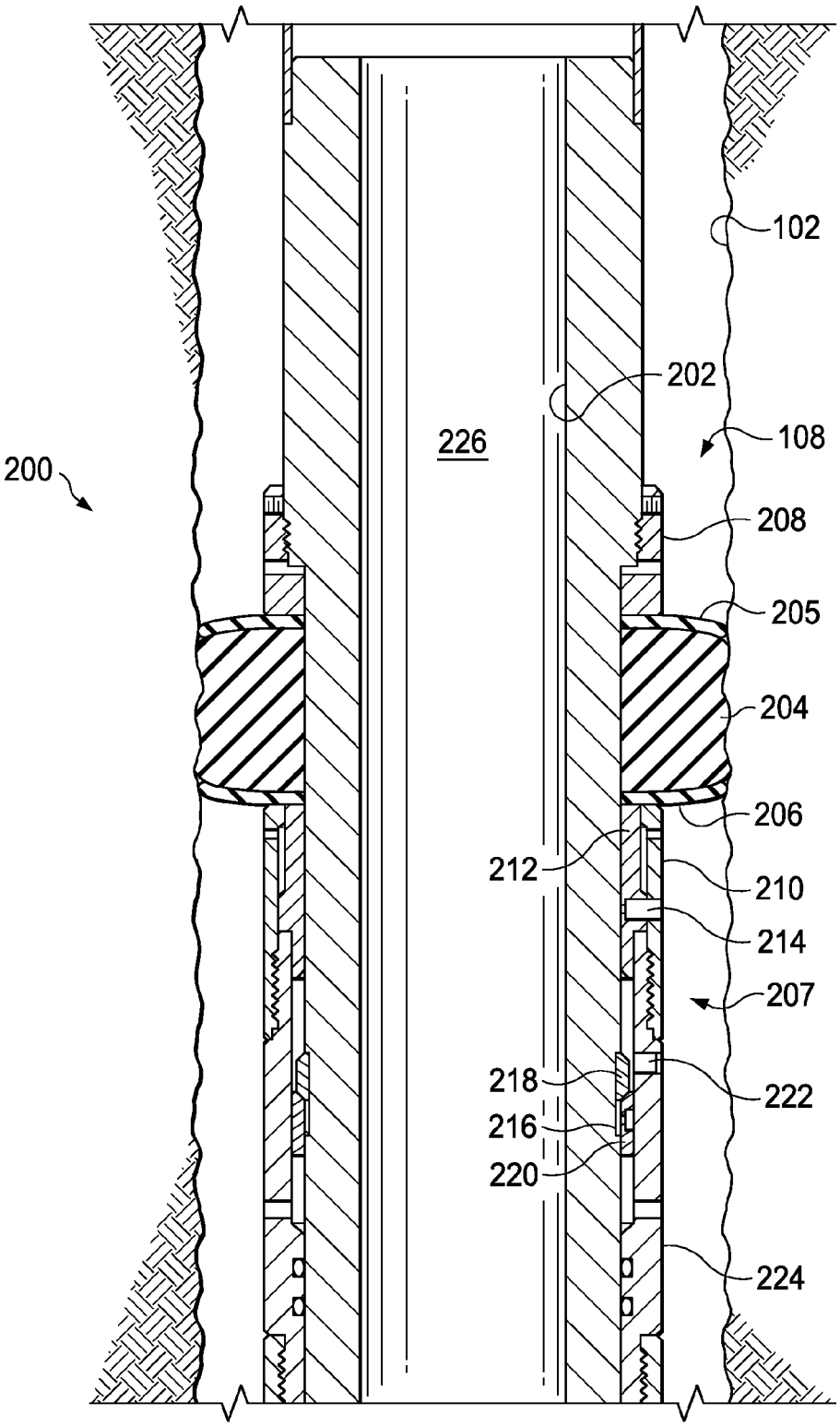
FIGS. 4A-4B illustrate more detailed sectional views of an example well tool string that includes a fold-back assembly in a second actuated position.
Figure 4B:
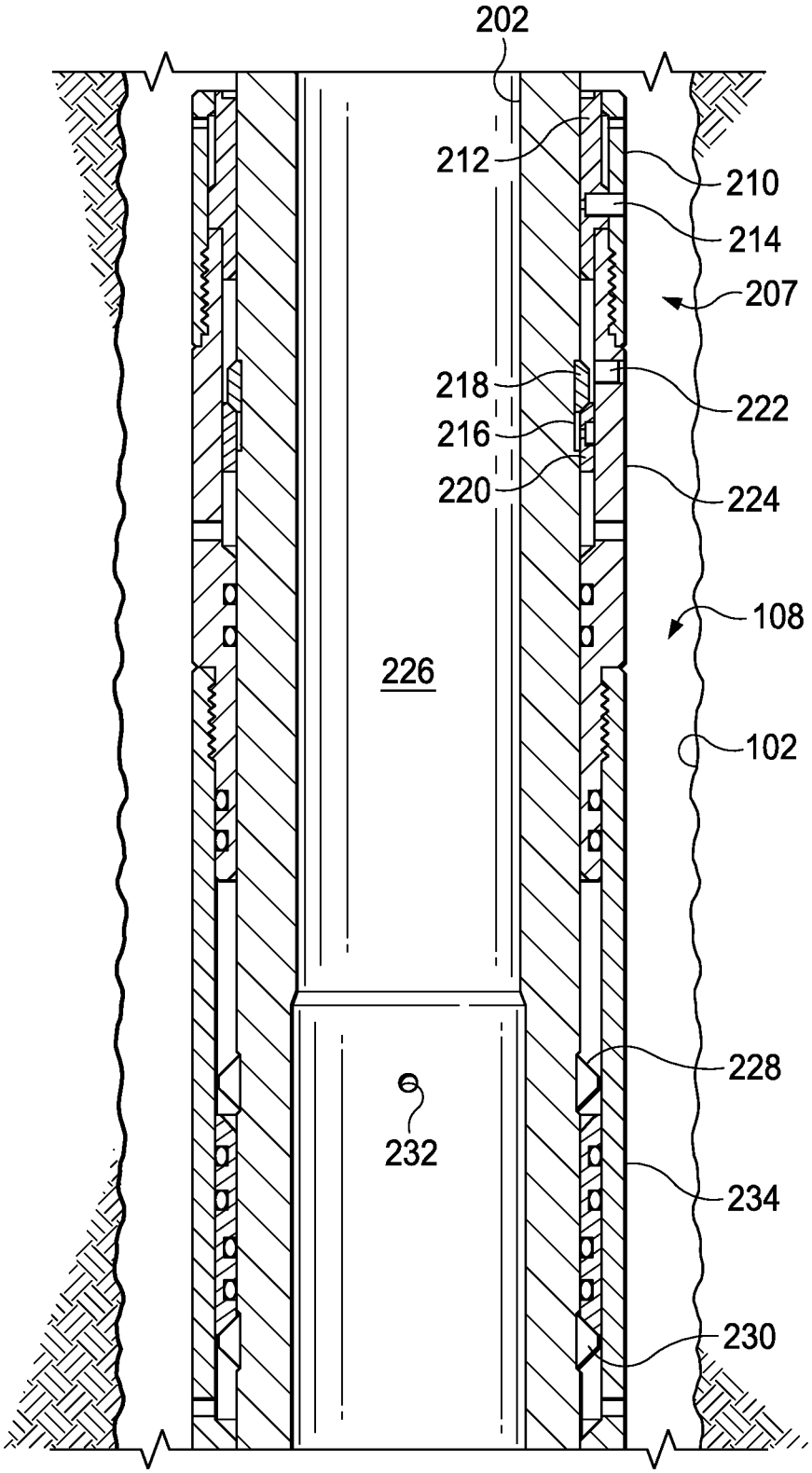

Turning to FIGS. 4A-4B, the well tool string 200 is illustrated in a second actuated position with the expandable member 204 activated (e.g., inflated, squeezed, or otherwise) to a second expanded position. In some implementations, the second expanded position may correlate to a particular inflation percentage of the expandable member 204 to contactingly engage the well bore 102 of a particular inner diameter (e.g., a maximum inner diameter of a range of inner diameters). In the second position, like the first, the well tool string 200 is fully operational in that no additional actuation may be necessary to begin operations (e.g., production operations) with the expandable member 204 engaged with the well bore 102.

In one example operation, the well tool string 200 is adjusted from the first actuated position to the second actuated position by applying an additional force (e.g., mechanical, hydraulic, hydrostatic) to the piston housing 234. In some implementations, for example, fluid is further circulated through the port 232 in order to apply a further uphole-directed force on the piston housing 234. In response, the piston housing 234 transmits the force (directly or indirectly) to the fold-back assembly 207 (e.g., through the adapter 224). The fold-back assembly 207 then moves as a unit, for instance, to contact the back-up shoe 206 with the lower retainer 210 and the sleeve 212 (e.g., simultaneously or substantially simultaneously). The force is transmitted to the expandable member 204, which abuts the upper retainer 208 and is squeezed together to expand to its first expansion position.

As illustrated, in the second actuated position, the snap ring 218 is further urged uphole by the shear ring 220 and is urged to an uphole end of the groove 216 that is formed on the mandrel 202. At the uphole end of the groove 216, the snap ring 218, as shown, abuts a shoulder of the groove 216 and is thus restrained from further uphole movement. In adjusting from the first actuated position to the second actuated position, the shear member 222 is sheared by the uphole directed force (e.g., mechanical, hydraulic, or hydrostatic), thereby releasing the shear ring 220 from the adapter 224. The adapter 224, therefore, is free to move further uphole while the shear ring 220 remains substantially static and abutting the snap ring 218.

Figure 5A:
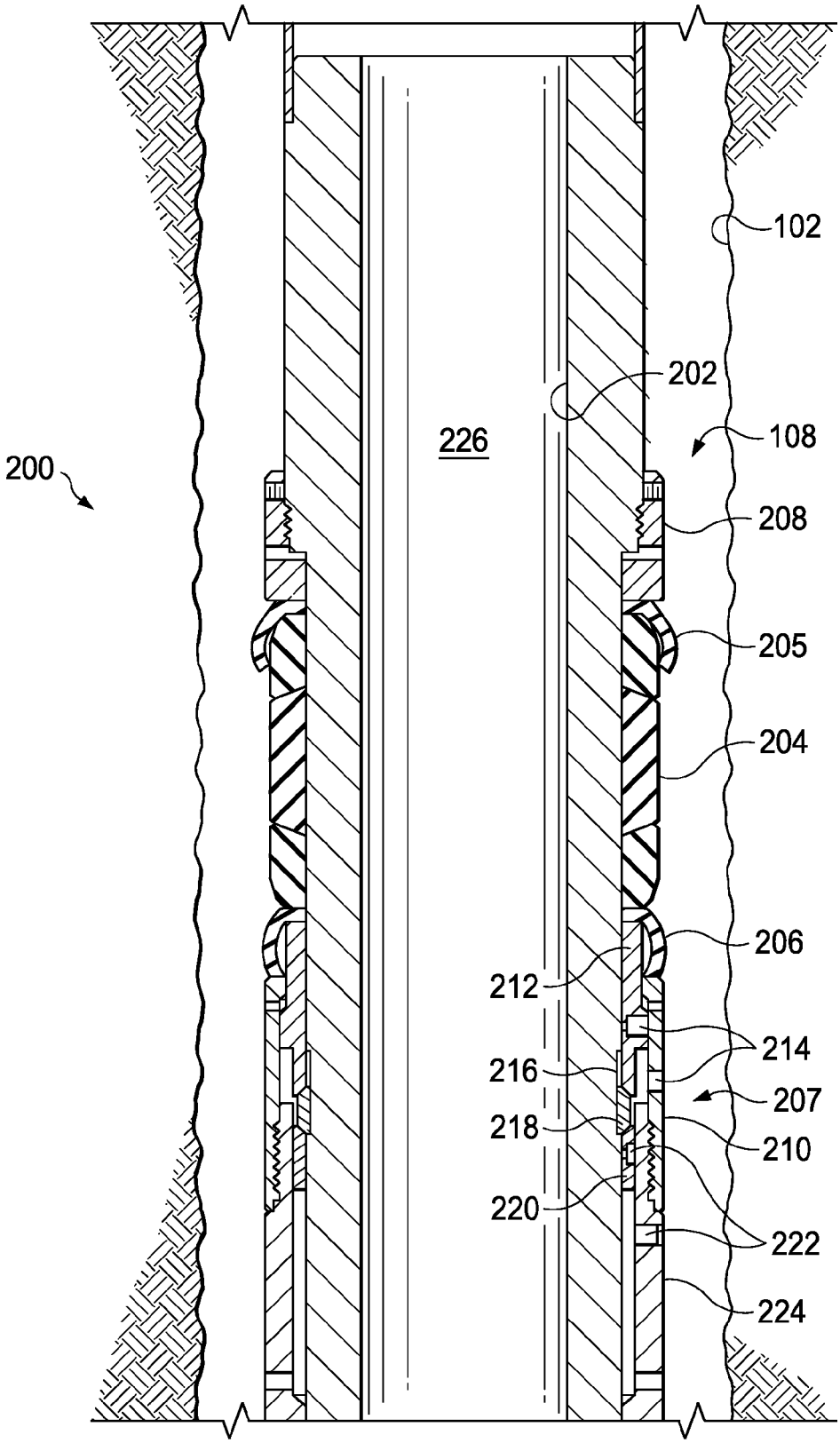
FIGS. 5A-5B illustrate more detailed sectional views of an example well tool string that includes a fold-back assembly in a retrieval position.
Figure 5B:
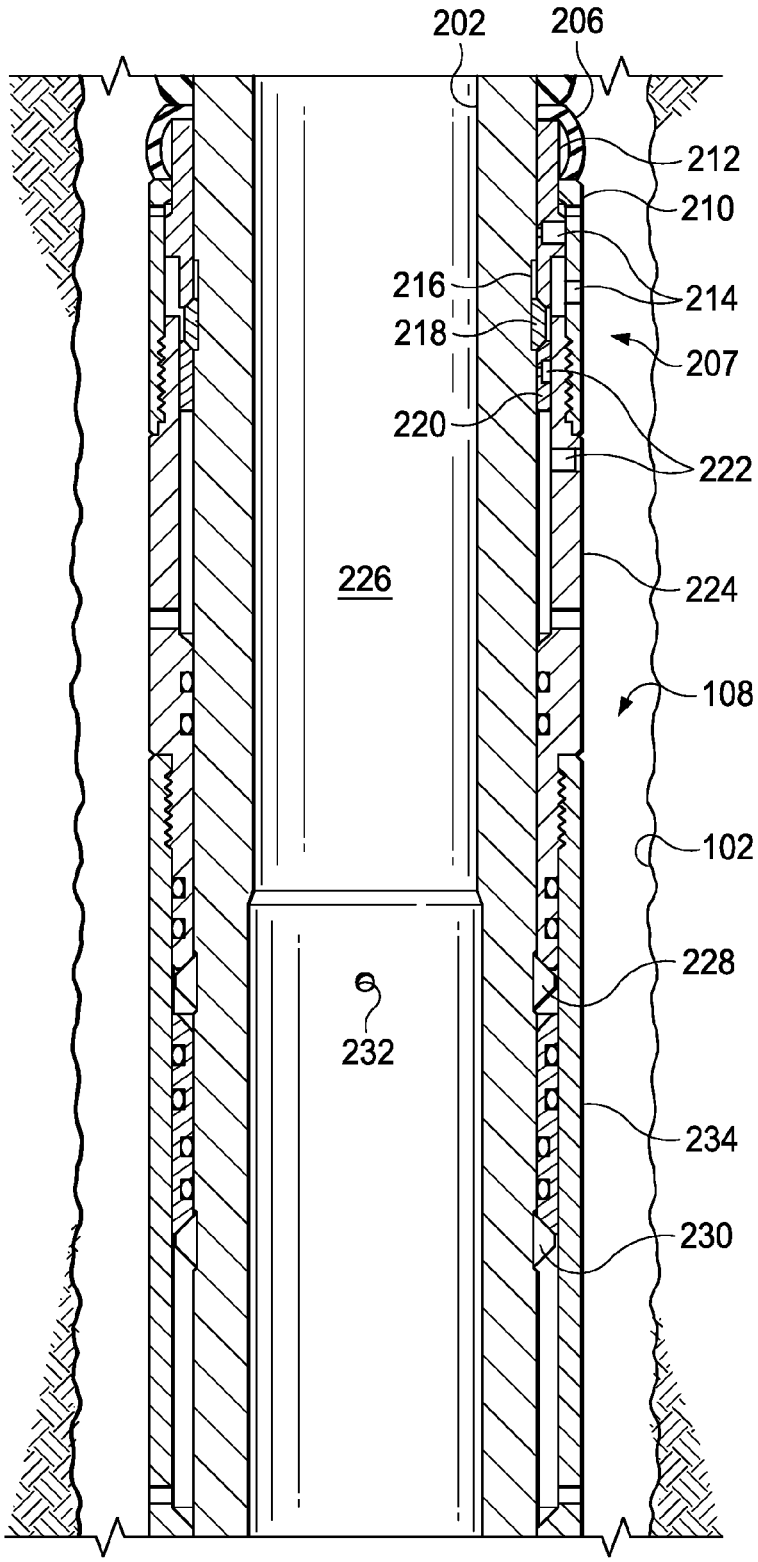

Turning now to, FIGS. 5A-5B, the example well tool string 200 is illustrated in a retrieval position. For example, in some implementations, the retrieval position may be a position in which the expandable member 204 is retracted from the first expanded position (as shown in FIGS. 3A-3B), the second expanded position (as shown in FIGS. 4A-4B), or other expanded position. For example, after a downhole operation has been completed by, for instance, a well tool that is part of or coupled to the well tool string 200, it may be desirable to retract the expandable member 204 in order to, for instance, move the well tool string 200 uphole and even out of the well bore 102.

In some implementations, to retract the expandable member 204 and prepare the well tool string 200 to be placed in the retrieval position, a retrieval tool may be used to release the expandable member and retrieve the tool string 200. For example, the expandable member 204 may remain substantially set even when, for example, hydraulic pressure is bled off from the tool string 200. Generally, a dedicated retrieval tool may be used to activate a release mechanism located downhole of the slips 122 with an upward mechanical shift.

As the well tool string 200 moves to the retrieval position, the lower retainer 210 moves away from the upper retainer 208 and the expandable member 204 may partially or fully retract. The back-up shoe 206 remains radially expanded to the well bore as it has been permanently deformed into a new shape. The fold-back assembly 207 aids the retrieval position by folding the back-up shoe 206 backward when the packer is axially moved. The back-up shoe 206 is folded backward (e.g., toward a downhole direction) with uphole movement of the tubing string. In some implementations, folding back of the back-up shoe 206 may aid in retrieval of the well tool string 200 by, for instance, minimizing catch points on the well tool string 200 that may engage the well bore 102 and/or tubular (e.g., a casing or casing collar) while the well tool string 200 is moved uphole.

In one example operation to adjust the well tool string 200 to the retrieval position, the mandrel 202 is lifted in the uphole direction. As the mandrel 202 is lifted uphole, the snap ring 218 abuts the lower side of the groove 216 on the mandrel 202 and engages a shoulder on an inner portion of the sleeve 212. The lower retainer 210 remains stationary as the mandrel 202 and sleeve 212 move upwards to shear the shear member 214 and sleeve 212 moves partly out from under lower retainer 210. After the shear member 214 shears, the lug 228 engages a shoulder on the inner portion of the adapter 224 so that the mandrel 202 and lower retainer 210 move upwards together. Continued upper movement of the mandrel 202 brings the sleeve 212 into contract with the expanded back-up shoe 206. The back-up shoe 206 is forced to invert and fold backwards over sleeve 212 Lifting the adapter 224 moves a shoulder on the adapter to abut a shoulder on a lower sleeve to lift the lower sleeve out of engagement with slips (e.g., the slips 122) to allow the slips to radially retract.

Figure 6:
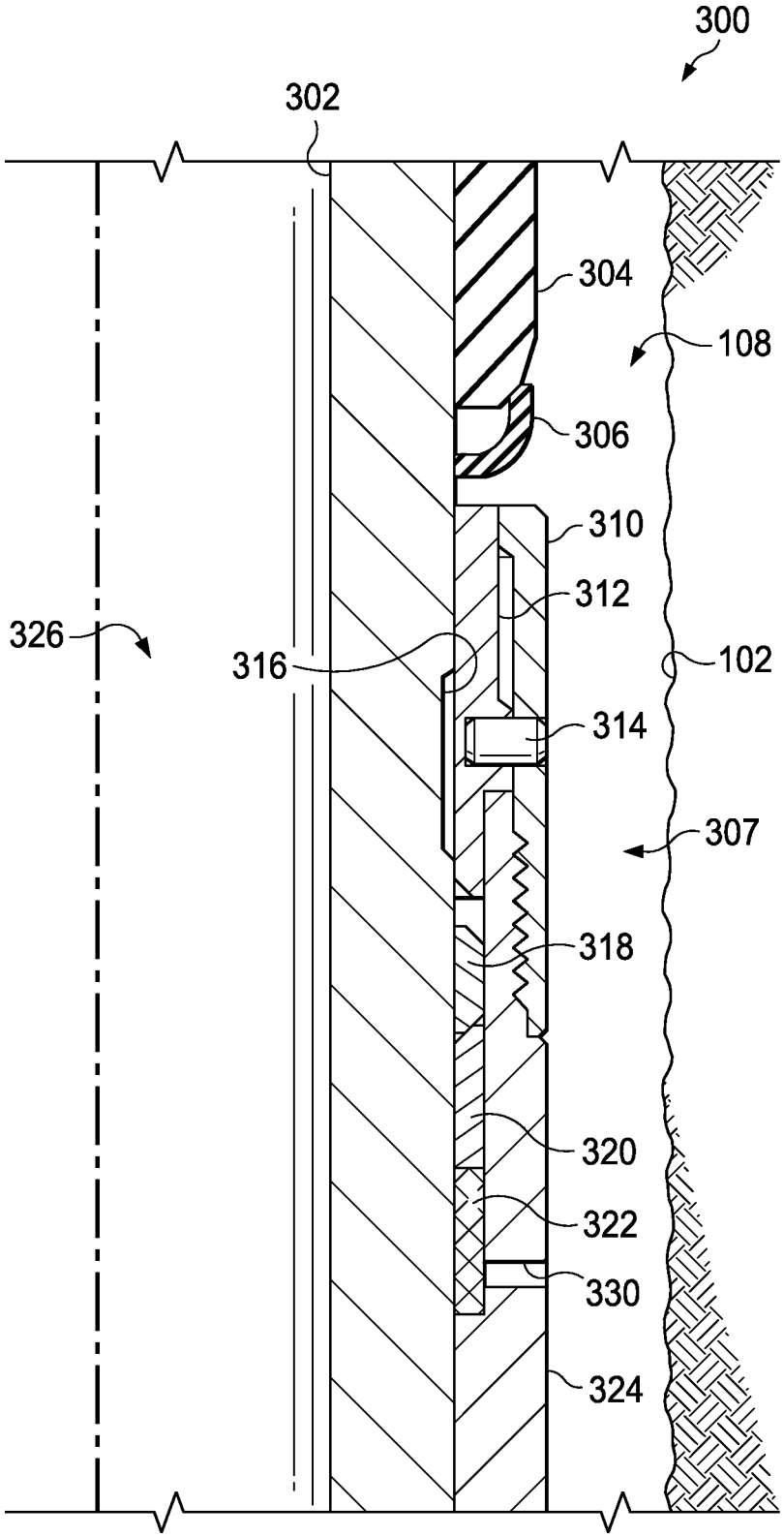
FIG. 6 illustrates a sectional view of a portion of another example well tool string that includes a fold-back assembly in a run-in position.

FIG. 6 illustrates a sectional view of a portion of another example well tool string that includes a fold-back assembly in a run-in position. In some implementations, the portion illustrated in FIG. 6 is a portion of a well tool 300 with a back-up shoe 306. For instance, the well tool 300 may be used in place of (or in addition to) the well tool 200 shown in the FIGS. 2A-5B and, for instance, may be actuated to urge the back-up shoe 306 into a position directed in a downhole direction (such as shown in FIGS. 5A-5B). In the illustrated example of the well tool 300, for instance, a biasing member 322 and push ring 320 may be substituted for the shear member 222 and shear ring 220 of the well tool 200.

As illustrated, the well tool 300 includes a mandrel 302 that extends from an uphole portion of a tool string towards a downhole end of the tool string and defines a bore 326 therethrough. An expandable member 304 rides on the mandrel 302 and is flanked on a downhole side the back-up shoe 306. An upper retainer (not shown) rides on the mandrel 302 uphole of the expandable member 304 and the back-up shoe 306 and provides a setting shoulder against which the expandable member 304 may be compressed (e.g., to radially expand the element 304 toward the well bore 102).

Riding on the mandrel 302 downhole of the back-up shoe 306 is a fold-back assembly 307 that includes a lower retainer 310 and a sleeve 312 that are carried on the mandrel 302 and fixed together in the run-in position by a shear member 314. The lower retainer 310 also coupled to adapter 324. Riding on the mandrel 302 between the push ring 320 and the sleeve 312 is a snap ring 318. As illustrated, the snap ring 318, in the run-in position, is positioned downhole from a groove 316 milled into an outer radial surface of the mandrel 302. The groove 316 is formed, in this example, implementation, at a determined location from the expandable member 304 and with a determined width. In some implementations, the determined location and/or determined width of the groove 316 on the mandrel 302 is based on one or more characteristics of the expandable member 304. For example, in some implementations, the groove 316 (as well as, in some cases, the snap ring 318) may be designed (e.g., width, location, size) based on a minimum expansion size of the expandable member 304, a maximum expansion size of the expandable member 304, or a combination thereof.

In operation of the fold-back assembly 307, when the expandable member 304 is positioned at a particular location in the well bore 102 and actuation of the element 304 begins, the biasing member 322 starts to compress, which slides the snap ring 318 into the groove 316. After the snap ring 318 moves into the groove 316, the biasing member 322 continues to compress in order to make up for the remaining travel required to set the expandable member 304 at a particular expanded position (e.g., a first expanded position, a second expanded position, or otherwise). The biasing member 322, in some implementations, is designed to have a final length that is greater than a closed length. Thus, the biasing member 322 may compress without affecting the setting stroke to set the expandable member 304.

As illustrated in FIG. 6, the biasing member 322 may be a spring, such as a compression spring, Belleville washer(s), or other mechanical device that may store mechanical energy. Alternatively, as another example, the biasing member 322 may be a thermoplastic (e.g., a polymer or other substance that is pliable or moldable at a particular temperature) member (e.g., a thermoplastic cylinder) or a wax cylinder that is positioned between a shoulder of the adapter 324 and the push ring 320. The thermoplastic cylinder may be a material such as polytetrafluoroethylene ("PTFE") or purified terephthalic acid ("PLA"). The thermoplastic or wax cylinder may be selected based on the desired properties at a given temperature. In such implementations, a bore 330 may be disposed through the adapter 324 between an outer radial surface (e.g., facing the well bore 102) and an inner radial surface (e.g., facing the biasing member 322. Dimensions of the bore 330 (e.g., diameter and/or length) may be selected to control a flowrate of extruded material (e.g., the thermoplastic or wax material) into the wellbore as it is compressed.

In operation of this embodiment that includes a thermoplastic member as the biasing member 322, when the expandable member 304 is positioned at a particular location in the well bore 102 and actuation of the element 304 begins, the thermoplastic cylinder contact and slides the snap ring 318 into the groove 316. After the snap ring 318 moves into the groove 316, the thermoplastic cylinder is put into compression at a glass transition temperature (e.g., a temperature in which the thermoplastic cylinder changes from a solid/brittle state to a malleable/molten state). Further compression on the thermoplastic cylinder (e.g., between the shoulder of the adapter 324 and the push ring 320) displaces the thermoplastic material out of the bore 330 formed in the adapter 324. Once the thermoplastic material starts to displace, the expandable member 304 continues the setting stroke. In some implementations, a force required to slide the snap ring 318 along the mandrel 302 is not enough to displace the thermoplastic material through the bore 330 and the thermoplastic only starts to displace once the snap ring 318 moves into the mandrel groove 316.

A number of examples have been described. Nevertheless, it will be understood that various modifications may be made. Accordingly, other examples are within the scope of the following claims.

What is claimed is:

1. A well tool comprising:
- a well packer that comprises an expandable member that rides on a mandrel extending at least a portion of the well tool;
- a hydraulic sub-assembly coupled to the well packer;
- an anti-preset assembly coupled to the hydraulic sub-assembly;
- a slip assembly coupled to the anti-preset assembly; and
- a fold-back assembly coupled between the well packer and the hydraulic sub-assembly, the fold-back assembly comprising:
  - a bias member carried on the mandrel and adapted to engage a profile formed on the mandrel based on a setting stroke that adjusts the expandable member into an expanded position in substantially sealing contact with a tubular; and
  - a ring member carried on the mandrel adjacent the bias member.

2. The well tool of claim 1, where the bias member is radially-biased inwardly toward the mandrel.

3. The well tool of claim 1, where the ring member comprises one of:
- a shear ring fixed to an adapter carried on the mandrel with a shear member;
- a spring positioned between a shoulder of the adapter and the bias member; or
- a moldable member positioned between a shoulder of the adapter and the bias member.

4. The well tool of claim 3, where the shear member is adapted to shear in response to a force to initiate the setting stroke to adjust the expandable member into the expanded position, and an uphole surface of the bias member defines a no-go shoulder in the extended position.

5. The well tool of claim 3, where the profile comprises a groove, and the spring maintains a substantially constant force on the bias member to urge the bias member into the groove.

6. The well tool of claim 3, where the moldable member comprises a thermoplastic member comprising a glass transition temperature at or below a particular temperature in the well bore, the thermoplastic member adapted to transfer a force from the adapter to the snap ring when the particular temperature is below the glass transition temperature, the thermoplastic member adapted to flow through a bore in the adapter in fluid communication with the well bore when the particular temperature is above the glass transition temperature.

7. The well tool of claim 1, where the bias member comprises a body lock ring, and the profile comprises a threaded surface adapted to engage the body lock ring.

8. The well tool of claim 1, where the bias member moves independently of operation of the hydraulic sub-assembly and the anti-preset assembly when the expandable member is adjusted to the expanded position.

9. A well tool comprising:

a well packer that comprises an expandable member that rides on a mandrel extending at least a portion of the well tool;

a hydraulic sub-assembly coupled to the well packer;

an anti-preset assembly coupled to the hydraulic sub-assembly;

a slip assembly coupled to the anti-preset assembly; and a fold-back assembly coupled between the well packer and the hydraulic sub-assembly, the fold-back assembly comprising a bias member carried on the mandrel and adapted to engage a profile formed on the mandrel based on a setting stroke that adjusts the expandable member into an expanded position in substantially sealing contact with a tubular, where the bias member is radially-biased inwardly toward the mandrel.

10. The well tool of claim 9, where the fold-back assembly further comprises a ring member carried on the mandrel adjacent the bias member, and where the ring member comprises one of:

a shear ring fixed to an adapter carried on the mandrel with a shear member;

a spring positioned between a shoulder of the adapter and the bias member; or a moldable member positioned between a shoulder of the adapter and the bias member.

11. The well tool of claim 10, where the shear member is adapted to shear in response to a force to initiate the setting stroke to adjust the expandable member into the expanded position, and an uphole surface of the bias member defines a no-go shoulder in the extended position.

12. The well tool of claim 10, where the profile comprises a groove, and the spring maintains a substantially constant force on the bias member to urge the bias member into the groove.

13. The well tool of claim 10, where the moldable member comprises a thermoplastic member comprising a glass transition temperature at or below a particular temperature in the well bore, the thermoplastic member adapted to transfer a force from the adapter to the snap ring when the particular temperature is below the glass transition temperature, the thermoplastic member adapted to flow through a bore in the adapter in fluid communication with the well bore when the particular temperature is above the glass transition temperature.

14. The well tool of claim 9, where the bias member comprises a body lock ring, and the profile comprises a threaded surface adapted to engage the body lock ring.

15. The well tool of claim 9, where the bias member moves independently of operation of the hydraulic sub-assembly and the anti-preset assembly when the expandable member is adjusted to the expanded position.

16. A well tool comprising:

a well packer that comprises an expandable member that rides on a mandrel extending at least a portion of the well tool;

a hydraulic sub-assembly coupled to the well packer;

an anti-preset assembly coupled to the hydraulic sub-assembly;

a slip assembly coupled to the anti-preset assembly; and a fold-back assembly coupled between the well packer and the hydraulic sub-assembly, the fold-back assembly comprising a bias member carried on the mandrel and adapted to engage a profile formed on the mandrel based on a setting stroke that adjusts the expandable member into an expanded position in substantially sealing contact with a tubular, where the bias member moves independently of operation of the hydraulic sub-assembly and the anti-preset assembly when the expandable member is adjusted to the expanded position.

17. The well tool of claim 16, where the fold-back assembly further comprises a ring member carried on the mandrel adjacent the bias member, and where the ring member comprises one of:

a shear ring fixed to an adapter carried on the mandrel with a shear member;

a spring positioned between a shoulder of the adapter and the bias member; or a moldable member positioned between a shoulder of the adapter and the bias member.

18. The well tool of claim 17, where the shear member is adapted to shear in response to a force to initiate the setting stroke to adjust the expandable member into the expanded position, and an uphole surface of the bias member defines a no-go shoulder in the extended position.

19. The well tool of claim 17, where the profile comprises a groove, and the spring maintains a substantially constant force on the bias member to urge the bias member into the groove.

20. The well tool of claim 17, where the moldable member comprises a thermoplastic member comprising a glass transition temperature at or below a particular temperature in the well bore, the thermoplastic member adapted to transfer a force from the adapter to the snap ring when the particular temperature is below the glass transition temperature, the thermoplastic member adapted to flow through a bore in the adapter in fluid communication with the well bore when the particular temperature is above the glass transition temperature.

21. The well tool of claim 16, where the bias member comprises a body lock ring, and the profile comprises a threaded surface adapted to engage the body lock ring.

22. The well tool of claim 16, where the bias member is radially-biased inwardly toward the mandrel.

* * * * *